US010898052B2

(12) United States Patent
Hellwig et al.

(10) Patent No.: US 10,898,052 B2
(45) Date of Patent: Jan. 26, 2021

(54) DOMESTIC DISHWASHER

(71) Applicant: BSH Hausgeräte GmbH, Munich (DE)

(72) Inventors: Jürgen Hellwig, Dischingen (DE); Anton Oblinger, Wertingen (DE); Gerhard Fetzer, Gundelfingen (DE)

(73) Assignee: BSH Hausgeräte GmbH, Munich (DE)

( * ) Notice: Subject to any disclaimer, the term of this patent is extended or adjusted under 35 U.S.C. 154(b) by 80 days.

(21) Appl. No.: 16/323,533

(22) PCT Filed: Sep. 8, 2017

(86) PCT No.: PCT/EP2017/072553
§ 371 (c)(1),
(2) Date: Feb. 6, 2019

(87) PCT Pub. No.: WO2018/050548
PCT Pub. Date: Mar. 22, 2018

(65) Prior Publication Data

US 2019/0159653 A1 May 30, 2019

(30) Foreign Application Priority Data

Sep. 19, 2016 (DE) ..... 10 2016 217 912

(51) Int. Cl.
*A47L 15/22* (2006.01)
*A47L 15/42* (2006.01)
*A47L 15/23* (2006.01)

(52) U.S. Cl.
CPC ..... *A47L 15/22* (2013.01); *A47L 15/23* (2013.01); *A47L 15/4282* (2013.01)

(58) Field of Classification Search
CPC ..... A47L 15/22; A47L 15/4282; A47L 15/23
See application file for complete search history.

(56) References Cited

U.S. PATENT DOCUMENTS 5,464,482 A 11/1995 Michael et al.
8,377,226 B2 2/2013 Favaro et al.
2014/0053873 A1* 2/2014 Watson ..... A47L 15/0031 134/18

FOREIGN PATENT DOCUMENTS

DE 19824824 A1 12/1999
DE 102006007329 A1 8/2007
(Continued)

OTHER PUBLICATIONS

National Search Report DE 10 2016 217 912.8 dated Apr. 28, 2017.
International Search Report PCT/EP2017/072553 dated Oct. 11, 2017.

*Primary Examiner* — Benjamin L Osterhout
(74) *Attorney, Agent, or Firm* — Michael E. Tschupp; Andre Pallapies; Brandon G. Braun

(57) ABSTRACT

A household dishwasher includes a first spray arm having a first spraying circle, a second spray arm having a second spraying circle which overlaps with the first spraying circle, and a synchronization facility configured to adapt a rotational speed of the first spray arm to a rotational speed of the second spray arm, or vice versa. The synchronization facility includes a first magnetic field allocated to the first spray arm and a second magnetic field allocated to the second spray arm, with the first magnetic field and the second magnetic field having a same polarization, so that the first magnetic field and the second magnetic field repel one another during operation of the household dishwasher to thereby prevent contact between the first spray arm and the second spray arm during a rotational movement of the first spray arm and the second spray arm.

11 Claims, 4 Drawing Sheets

(56) References Cited

FOREIGN PATENT DOCUMENTS

| | | | |
|---|---|---|---|
| DE | 102010032005 | A1 | 1/2012 |
| EP | 0559466 | A1 | 9/1993 |
| EP | 0727177 | A2 | 8/1996 |
| EP | 1743566 | A2 | 1/2007 |
| EP | 2384683 | B1 | 4/2014 |
| JP | 2000107116 | A | 4/2000 |
| WO | 2011035903 | A2 | 3/2011 |

* cited by examiner

DOMESTIC DISHWASHER

CROSS-REFERENCES TO RELATED APPLICATIONS

This application is the U.S. National Stage of International Application No. PCT/EP2017/072553, filed Sep. 8, 2017, which designated the United States and has been published as International Publication No. WO 2018/050548 A1 and which claims the priority of German Patent Application, Serial No. 10 2016 217 912.8, filed Sep. 19, 2016, pursuant to 35 U.S.C. 119(a)-(d).

BACKGROUND OF THE INVENTION

The present invention relates to a household dishwasher.

In household dishwashers, washing liquor is applied to items to be washed for the most part with the aid of rotatable spray arms. Spray arms of this kind comprise a large number of spray arm nozzles, through which the washing liquor issues. The recoil of the issuing washing liquor sets the spray arm into rotation. Since the spray arm nozzles move on a circular path, a round dish basket adapted to said circular path is ideal with regard to applying washing liquor to the items to be washed. Since the basic shape of most household dishwashers extends in the longitudinal and width directions, however, in the case of a polygonal dish basket there may also be regions to which washing liquor is not able to be optimally applied. In order to keep the spray shadows as low as possible, instead of one spray arm a plurality of spray arms could be used. If a plurality of interlocking spray arms are arranged on an identical spray arm plane, a mutual control of the interlocking spray arms is necessary. This can take place via belts, toothed lock washers, gear wheels, multiphase motors, electronic brakes or the like.

WO 2004/023968 A2 describes a dishwasher with a first spray arm and a second spray arm. The spray arms are arranged in different spray arm planes, wherein the axes of rotation of the spray arms are tilted with respect to one another.

EP 0 559 466 B1 describes a dishwasher with a plurality of spray arms, which are arranged in different spray arm planes, so that the spray arms are placed above one another.

BRIEF SUMMARY OF THE INVENTION

Against this background, one object of the present invention consists in providing an improved household dishwasher.

Accordingly, a household dishwasher is proposed with a first spray arm, which has a first spraying circle, and a second spray arm, which has a second spraying circle which overlaps with the first spraying circle, and a synchronization facility, which is configured to adapt a rotational speed of the first spray arm to a rotational speed of the second spray arm, or vice versa. The synchronization facility comprises a first magnetic field allocated to the first spray arm and a second magnetic field allocated to the second spray arm, wherein the first magnetic field and the second magnetic field have the same polarization, so that the first magnetic field and the second magnetic field repel one another during operation of the household dishwasher, in order to prevent contact between the first spray arm and the second spray arm during a rotational movement of the same.

The first magnetic field and the second magnetic field are both embodied as north pole or as south pole in each case, for example. The synchronization facility makes it possible to synchronize the rotational speed of the first spray arm and the rotational speed of the second spray arm, without a mechanical coupling of the spray arms being necessary. The first magnetic field and the second magnetic field are in each case generated with the aid of a magnet element or a magnetizable, in particular ferromagnetic material. The magnetic field and/or the magnetizable material may be part of the synchronization facility. The synchronization facility may comprise a large number of magnetic fields. The spraying circles overlap in an overlap region in particular. In the overlap region, washing liquor is particularly intensively applied to the items to be washed, whereby a particularly effective cleaning action results in the overlap region.

In accordance with one embodiment, the first spray arm and the second spray arm are arranged in a common spray arm plane.

The spray arm plane may for example run through the center of the two spray arms and divide these into an upper shell and a lower shell in each case. Alternatively, the spray arm planes may also be spanned by spray arm nozzles of the spray arms. As a result of the first spray arm and the second spray arm being arranged in a common spray arm plane, these interlock with one another during a rotational movement. This results in a particularly low space requirement in a height direction.

In accordance with a further embodiment, the first spray arm and/or the second spray arm are at least partially manufactured from a magnetizable material.

It is possible to dispense with additional magnet elements as a result. In particular, the magnetizable material is a ferromagnetic material.

In accordance with a further embodiment, the first spray arm and/or the second spray arm are at least partially manufactured from metal or a magnetizable plastic material.

For example, the spray arms each have an upper shell and a lower shell, which are interconnected with the aid of molded-on connection elements. The connection elements may be manufactured from the magnetizable plastic material. As a result, it is possible to achieve a material saving due to the economical use of the magnetizable plastic material. Alternatively, for example, the spray arms may be manufactured from a magnetizable metal sheet, at least in sections.

In accordance with a further embodiment, the first spray arm and/or the second spray arm each have a magnet element, in particular a permanent magnet element.

The magnet element may, for example, be bonded or clipped onto the respective spray arm. Alternatively, the magnet element may be arranged within the material of the respective spray arm.

In accordance with a further embodiment, the magnet element is overmolded with a plastic material.

The magnet element is protected from moisture as a result. It is possible to dispense with additional fastening means for fastening the magnet element to the respective spray arm.

In accordance with a further embodiment, each spray arm is allocated two magnetic fields with different polarization in each case.

Preferably, each spray arm is allocated four magnetic fields in each case, wherein two magnetic fields have the same polarization in each case. This means that two magnetic fields are embodied as south pole and two magnetic fields as north pole in each case.

In accordance with a further embodiment, each spray arm has a first spray arm section, a second spray arm section and an axis of rotation arranged centrally between the spray arm sections, wherein each spray arm section is allocated two magnetic fields with different polarization.

The number of spray arm sections is freely selectable. Three or four spray arm sections may also be provided. With the aid of the axis of rotation, the respective spray arm is rotatably mounted on a dishwasher cavity of the household dishwasher. Washing liquor is also able to be fed to the respective spray arm via the axis of rotation.

In accordance with a further embodiment, the household dishwasher comprises a third to nth spray arm, which has a third to nth spraying circle overlapping with the first spraying circle or the second spraying circle, wherein the third to nth spraying circle is allocated a third to nth magnetic field, wherein the first magnetic field or the second magnetic field and the third to nth magnetic field have the same polarization, so that the first magnetic field or the second magnetic field and the third to nth magnetic field repel one another during operation of the household dishwasher, in order to prevent contact between the first spray arm or the second spray arm and the third to nth spray arm during a rotational movement of the same.

The number of spray arms is freely selectable. For example, six spray arms are provided. Preferably, n is greater than four and is an integer. In particular, the spray arms may have spraying circles with different diameters. For example, a third to sixth spray arm each has a spraying circle, the diameter of which is smaller than a diameter of a respective spraying circle of the first spray arm and of the second spray arm. The third to sixth spray arm may then in each case be arranged in a corner of a receptacle for items to be washed of the household dishwasher. A particularly even application of washing liquor to the items to be washed can be achieved as a result.

In accordance with a further embodiment, the household dishwasher comprises a dishwasher cavity, on which the spray arms are installed in a rotatable manner.

Alternatively, the spray arms may also be installed in a rotatable manner on receptacles for items to be washed of the household dishwasher. The household dishwasher preferably comprises a large number of receptacles for items to be washed, which are placed above one another in the dishwasher cavity. Each receptacle for items to be washed may be allocated a large number of spray arms, which are arranged above or below the respective receptacle for items to be washed in each case.

Further possible implementations of the household dishwasher also comprise combinations—not explicitly cited—of features or embodiments described above or below in respect of the exemplary embodiments. Here the person skilled in the art will also add individual aspects as improvements or amendments to the respective basic form of the household dishwasher.

BRIEF DESCRIPTION OF THE DRAWINGS

Further advantageous embodiments and aspects of the household dishwasher form the subject matter of the subclaims and the exemplary embodiments of the household dishwasher described below. The household dishwasher is also described in greater detail on the basis of preferred embodiments with reference to the attached figures.

DETAILED DESCRIPTION OF EXEMPLARY EMBODIMENTS OF THE PRESENT INVENTION

Figure 1:
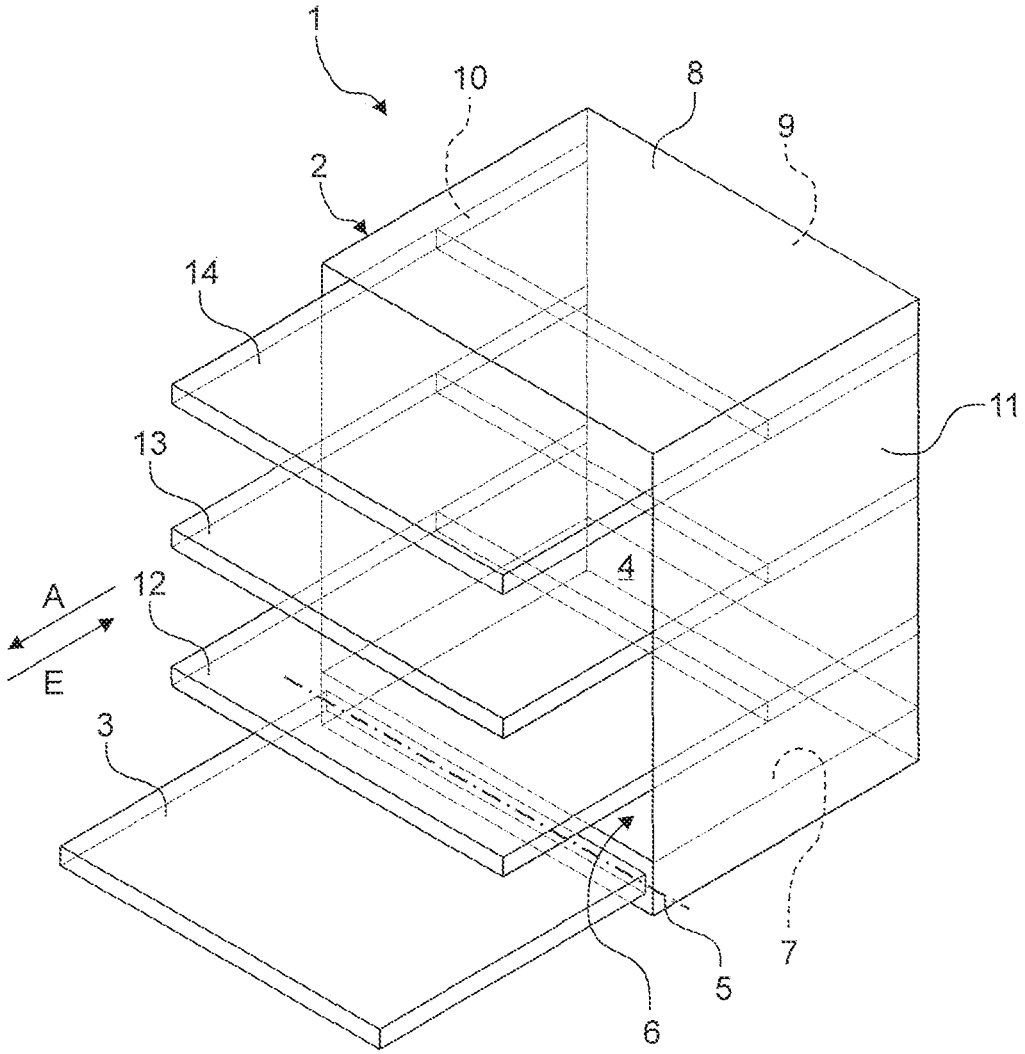
FIG. 1 shows a schematic perspective view of an embodiment of a household dishwasher.

In the figures, elements that are identical or have the same function are denoted by the same reference characters unless otherwise stated.

FIG. 1 shows a schematic perspective view of an embodiment of a household dishwasher 1. The household dishwasher 1 has a dishwasher cavity 2, which can be closed by a door 3, in particular in a watertight manner. A sealing facility can be provided for this purpose between the door 3 and the dishwasher cavity 2. The dishwasher cavity 2 is preferably cuboid in shape. The dishwasher cavity 2 may be arranged in a housing of the household dishwasher 1. The dishwasher cavity 2 and the door 3 may form a washing chamber 4 for washing items to be washed.

The door 3 is shown in its open position in FIG. 1. The door 3 can be closed or opened by pivoting about a pivot axis 5 provided at a lower end of the door 3. With the aid of the door 3, a loading opening 6 of the dishwasher cavity 2 can be closed or opened. The dishwasher cavity 2 has a base 7, a ceiling 8 arranged opposite to the base 7, a rear wall 9 arranged facing the closed door 3 and two side walls 10, 11 arranged facing one another. The base 7, the ceiling 8, the rear wall 9 and the side walls 10, 11 may be manufactured from a stainless steel sheet for example. Alternatively, the base 7 may be manufactured from a plastic material.

Furthermore, the household dishwasher 1 has at least one receptacle for items to be washed 12 to 14. Preferably, a plurality of receptacles for items to be washed 12 to 14, in particular three, are provided, wherein a first receptacle for items to be washed 12 may be a lower rack or lower basket, a second receptacle for items to be washed 13 may be an upper rack or upper basket and a third receptacle for items to be washed 14 may be a cutlery drawer. As additionally shown in FIG. 1, the receptacles for items to be washed 12 to 14 are arranged above one another in the dishwasher cavity 2. Each receptacle for items to be washed 12 to 14 is optionally able to be shifted into or out from the dishwasher cavity 2. Each receptacle for items to be washed 12 to 14 is able be inserted into the dishwasher cavity 2 in an insertion direction E and extracted from the dishwasher cavity 2 in an extraction direction A opposite to the insertion direction E.

Figure 2:
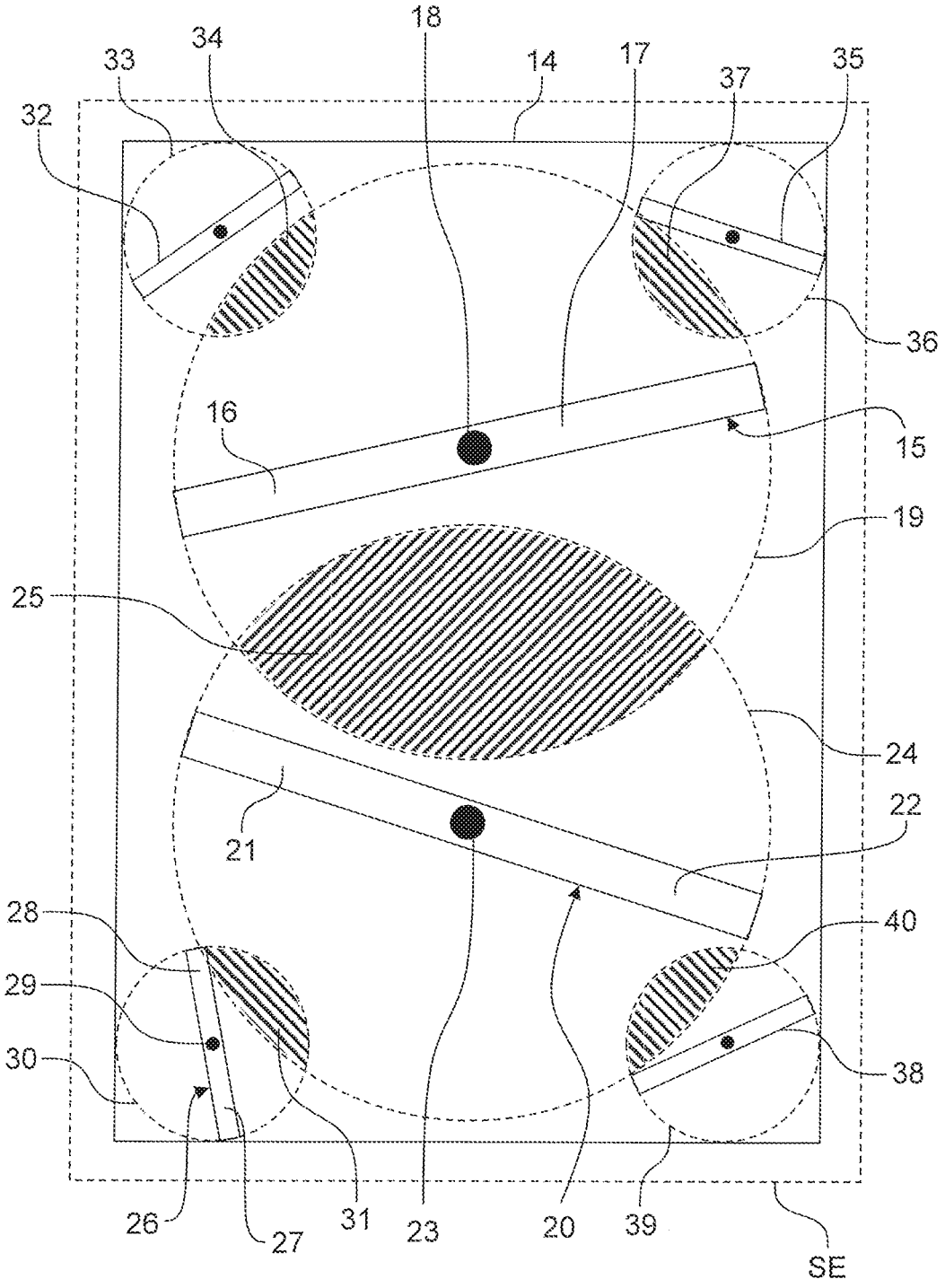
FIG. 2 shows a schematic top view of a receptacle for items to be washed for the dishwasher in accordance with FIG. 1.

FIG. 2 shows a schematic top view of the receptacle for items to be washed 14. The technical features explained below could also, however, apply to the receptacles for items to be washed 12, 13. The household dishwasher 1 comprises a first spray arm 15, which is rotatably mounted on the dishwasher cavity 2, in particular on the ceiling 8. The first spray arm 15 comprises a first spray arm section 16, a second spray arm section 17 and an axis of rotation 18 arranged centrally between the spray arm sections 16, 17. Washing liquor for cleaning items to be washed is able to be fed to the first spray arm 15 via the axis of rotation 18. With the aid of the axis of rotation 23, the second spray arm 20 is rotatably mounted on the dishwasher cavity 2. The first spray arm 15 has a first spraying circle 19, the center point of which is the axis of rotation 18.

The household dishwasher 1 additionally comprises a second spray arm 20, which, as with the first spray arm 15, has a first spray arm section 21, a second spray arm section 22 as well as an axis of rotation 23 arranged centrally between the spray arm sections 21, 22. Washing liquor is able to be fed to the second spray arm 20 via the axis of rotation 23. The second spray arm 20 comprises a second spraying circle 24, the center point of which is the axis of rotation 23.

The first spraying circle 19 and the second spraying circle 24 overlap one another in an overlap region 25 shaded in FIG. 2. This means, during operation of the household dishwasher 1, in which the spray arms 15, 20 rotate about their respective axes of rotation 18, 23, that the first spray arm 15 engages into the second spray arm 20 or vice versa.

The first spray arm 15 and the second spray arm 20 are arranged in a common spray arm plane SE. The spray arm plane SE may be arranged above one of the receptacles for items to be washed 12 to 14 in each case. For example, the spray arm plane SE may be arranged between the first receptacle for items to be washed 12 and the second receptacle for items to be washed 13, between the second receptacle for items to be washed 13 and the third receptacle for items to be washed 14 or above the third receptacle for items to be washed 14. The spray arm plane SE may also be arranged below the respective receptacle for items to be washed 12 to 14. Each receptacle for items to be washed 12 to 14 may also be allocated its own spray arm plane SE with the respective spray arms 12, 20. The spraying circles 19, 24 may have an equal diameter or different diameters.

The household dishwasher 1 may additionally have a third spray arm 26 with a first spray arm section 27, a second spray arm section 28 as well as an axis of rotation 29 arranged between the spray arm sections 27, 28. Washing liquor is able to be fed to the third spray arm 26 via the axis of rotation 29. The spray arm 26 is rotatably mounted on the dishwasher cavity 2 with the aid of the axis of rotation 29. The third spray arm 26 comprises a third spraying circle 30, the diameter of which is preferably smaller than the diameter of the spraying circles 19, 24. The third spraying circle 30 overlaps with the second spraying circle 24 in an overlap region 31, which is shown shaded in FIG. 2.

In addition, the household dishwasher 1 may comprise a fourth spray arm 32 with a fourth spraying circle 33, wherein the fourth spraying circle 33 overlaps with the first spraying circle 19 in an overlap region 34 shaded in FIG. 2. In this case, the fourth spray arm 32 is designed identically to the third spray arm 26. In addition, a fifth spray arm 35 with a fifth spraying circle 36 may be provided, which overlaps with the first spraying circle 19 in an overlap region 37 shown shaded. A sixth spray arm 38 comprises a sixth spraying circle 39, which in an overlap region 40 shown shaded overlaps with the second spraying circle 24. The spray arms 26, 32, 35, 38 are optional.

As shown in FIG. 2, the spray arms 26, 32, 35, 38 may be placed in a corner of the receptacle for items to be washed 14 in each case. The spraying circles 19, 24, 30, 33, 36, 39 therefore cover almost the entire receptacle for items to be washed 14, wherein in the overlap regions 25, 31, 34, 37, 40 a particular intensive application of washing liquor to the items to be washed is ensured. The number of spray arms 15, 20, 26, 32, 35, 38 is freely selectable. The household dishwasher 1, however, has at least the first spray arm 15 and the second spray arm 20.

Figure 3:
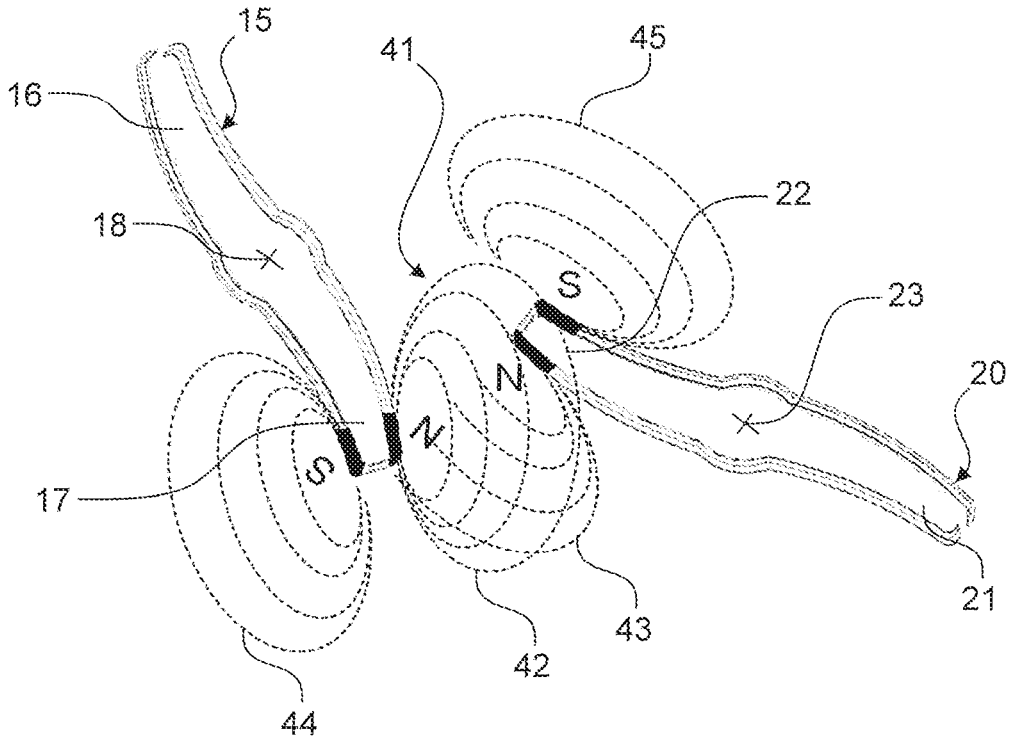
FIG. 3 shows a schematic view of a plurality of spray arms for the dishwasher in accordance with FIG. 1.

FIG. 3 shows the first spray arm 15 as well as the second spray arm 20 in a top view. The functionality of the spray arms 26, 32, 35, 38 corresponds to the functionality of the spray arms 15, 20. In the following, however, only the first spray arm 15 and the second spray arm 20 are referred to. The household dishwasher 1 comprises a synchronization facility 41, which is configured to adapt a rotational speed of the first spray arm 15 to a rotational speed of the second spray arm 20, or vice versa. In this context, however, the spray arms 15, 20 are mechanically uncoupled from one another. This means that there is no mechanical or electromechanical connection in the form of a gearing, belt, synchronized electric motors or the like between the first spray arm 15 and the second spray arm 20.

The synchronization facility 41 comprises a first magnetic field 42 allocated to the first spray arm 15 and a second magnetic field 43 allocated to the second spray arm 20. The first magnetic field 42 and the second magnetic field 43 have the same polarization. For example, the first magnetic field 42 and the second magnetic field 43 are embodied as north pole N, meaning that the first magnetic field 42 and the second magnetic field 43 repel one another during operation of the household dishwasher 1. As a result, contact between the first spray arm 15 and the second spray arm 20 is prevented during a rotational movement of the same.

Preferably, each spray arm section 16, 17, 21, 22 is allocated two magnetic fields 42, 44 and 43, 45 in each case. In this context, the two magnetic fields 42, 44 and 43, 45 of each spray arm section 16, 17, 21, 22 have different polarizations. For example, the magnetic fields 44, 45 are embodied as south pole S.

The first spray arm 15 and/or the second spray arm 20 are at least partially manufactured from a magnetizable material. For example, the spray arms 15, 20 may be manufactured from metal or at least partially from metal. Alternatively, the spray arms 15, 20 may be at least partially manufactured from a magnetizable metal sheet. To this end, for example, a two-component injection molding process can be used.

Figure 4:
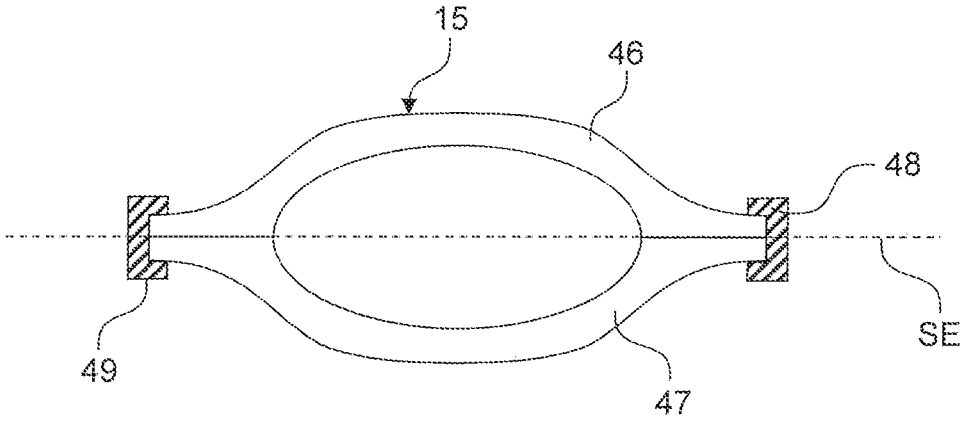
FIG. 4 shows a schematic sectional view of a spray arm for the dishwasher in accordance with FIG. 3.

For example, the spray arms 15, 20, as shown in FIG. 4, may in each case have an upper shell 46 and a lower shell 47, which are interconnected with the aid of subsequently molded-on connection elements 48, 49. The connection elements 48, 49 may be manufactured from the magnetizable plastic material, wherein for example the connection element 48 forms a north pole N and the connection element 49 forms a south pole S. The spray arm plane SE may run through the center of the spray arms 15, 20. The connection elements 48, 49 may be part of the synchronization facility 41.

Figure 5:
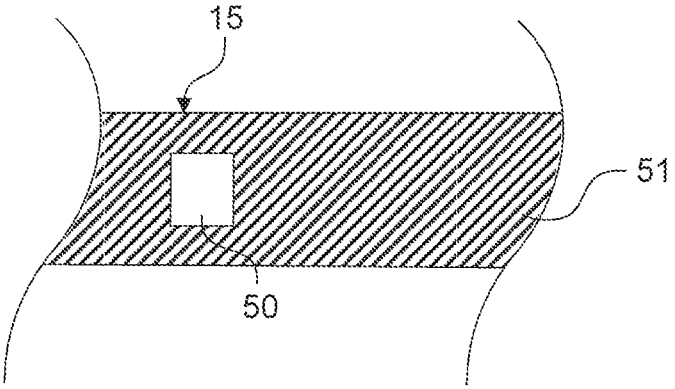
FIG. 5 shows a further schematic sectional view of a spray arm for the dishwasher in accordance with FIG. 1.

Alternatively, the spray arms 15, 20 may in each case have a magnet element 50, in particular a permanent magnet element, as shown in FIG. 5. The magnet element 50 may be overmolded with a plastic material 51 in a plastic injection molding process. The magnet element 50 may be part of the synchronization facility 41.

The functionality of the household dishwasher 1 is explained below. The spray arms 15, 20 comprise spray arm nozzles, through which the washing liquor issues into the washing chamber 4. Due to the pressure of the issuing washing liquor, the spray arms 15, 20, 26, 32, 35, 38 are set into rotation. With the aid of the synchronization facility 41, the repelling of the magnetic fields 42 to 45 ensures that there is no contact between the spray arms 15, 20, 26, 32, 35, 38 and a synchronization of the rotational speeds of the spray arms 15, 20, 26, 32, 35, 38 takes place. This means that the spray arms 15, 20, 26, 32, 35, 38 are accelerated or braked as a function of one another in each case.

With the aid of the synchronization facility 41, it is ensured that the spray arms 15, 20, 26, 32, 35, 38 are synchronized without a mechanical or electromechanical coupling. In this context, spray shadows can be minimized by using the small spray arms 26, 32, 35, 38. This may be achieved in particular by the small spray arms 26, 32, 35, 38 being placed in the corners of the receptacle for items to be washed 14. In the region of the dishwasher cavity 2 to which washing liquor is applied, it is therefore possible to dispense with electrical or mechanical synchronization means. As synchronization means are dispensed with, these also cannot malfunction. There is furthermore no risk of energy loss due to mechanical synchronization means.

When the household dishwasher 1 is switched off, it is possible to prevent the spray arms 15, 20, 26, 32, 35, 38 from colliding with one another during testing of a possible spray arm blockage due to rotation of one of the spray arms 15, 20, 26, 32, 35, 38. The spray arms 15, 20, 26, 32, 35, 38 can be simply removed for cleaning, without a gearing or other coupling means having to be taken into consideration. The spray arms 15, 20, 26, 32, 35, 38 do not need to be in the correct position. All spray arms 15, 20, 26, 32, 35, 38 can be used in a common spray arm plane SE, as they control one another. As corner nozzles or drive nozzles of the spray arms 15, 20, 26, 32, 35, 38 no longer need to set on such a slant as a result of the synchronization facility 41, the washing liquor comes into contact with the dishwasher cavity 2 in a flatter manner, whereby a lower noise generation is achieved.

Washing liquor is applied to the overlap regions 25, 31, 34, 37, 40 in a particularly intensive manner and can be highlighted for the user as intensive zones by color. Due to the large spraying circles 19, 24, the nozzle pressure can be reduced, as the nozzle spray angle can be better adapted for loading. The items to be washed, in particularly cups, can be placed at a steep angle, as the reachability of the items to be washed is improved by the larger spraying circles 19, 24. Due to the steeper cup position, less residual water remains at the bottom of the cup, which means that less water has to be evaporated. This leads to an energy saving.

Although the present invention has been described with reference to exemplary embodiments, it can be modified in numerous different ways.

The invention claimed is:

1. A household dishwasher, comprising:

a first spray arm having a first spraying circle;

a second spray arm having a second spraying circle which overlaps with the first spraying circle; and a synchronization facility configured to adapt a rotational speed of the first spray arm to a rotational speed of the second spray arm, or vice versa, said synchronization facility comprising a first magnetic field allocated to the first spray arm and a second magnetic field allocated to the second spray arm, with the first magnetic field and the second magnetic field having a same polarization, so that the first magnetic field and the second magnetic field repel one another during operation of the household dishwasher to thereby prevent contact between the first spray arm and the second spray arm during a rotational movement of the first spray arm and the second spray arm.

2. The household dishwasher of claim 1, wherein the first spray arm and the second spray arm are arranged in a common spray arm plane.

3. The household dishwasher of claim 1, wherein at least one of the first and second spray arms is at least partially manufactured from a magnetizable material.

4. The household dishwasher of claim 1, wherein at least one of the first and second spray arms is at least partially manufactured from metal or a magnetizable plastic material.

5. The household dishwasher of claim 1, wherein at least one of the first and second spray arms has a magnet element.

6. The household dishwasher of claim 5, wherein the magnet element is a permanent magnet element.

7. The household dishwasher of claim 5, wherein the magnet element is overmolded with a plastic material.

8. The household dishwasher of claim 1, further comprising a third to nth spray arm, which has a third to nth spraying circle overlapping with the first spraying circle or the second spraying circle, wherein the third to nth spraying circle is allocated a third to nth magnetic field, and wherein the first magnetic field or the second magnetic field and the third to nth magnetic field have a same polarization, so that the first magnetic field or the second magnetic field and the third to nth magnetic field repel one another during operation of the household dishwasher to thereby prevent contact between the first spray arm or the second spray arm and the third to nth spray arm during a rotational movement of the the first spray arm or the second spray arm and the third to nth spray arm.

9. The household dishwasher of claim 1, further comprising a dishwasher cavity, on which the first and second spray arms are installed in a rotatable manner.

10. A household dishwasher, comprising:

a first spray arm having a first spraying circle;

a second spray arm having a second spraying circle which overlaps with the first spraying circle; and a synchronization facility configured to adapt a rotational speed of the first spray arm to a rotational speed of the second spray arm, or vice versa, said synchronization facility comprising two magnetic fields with different polarization allocated to the first spray arm and two magnetic fields with different polarization allocated to the second spray arm, with one of the two magnetic fields of the first spray arm and one of the two magnetic fields of the second spray arm having a same polarization so as to repel one another during operation of the household dishwasher to thereby prevent contact between the first spray arm and the second spray arm during a rotational movement of the first spray arm and the second spray arm.

11. The household dishwasher of claim 10, wherein each of the first and second spray arms has a first spray arm section, a second spray arm section and an axis of rotation arranged centrally between the first and second spray arm sections, each of the first and second spray arm sections being allocated two magnetic fields with different polarization.

* * * * *